United States Patent [19]

Hamaoka et al.

[11] 4,157,915

[45] Jun. 12, 1979

[54] COLOR PHOTOGRAPHIC LIGHT-SENSITIVE MATERIAL CONTAINING DEVELOPMENT PRECURSOR

[75] Inventors: Tsutomu Hamaoka; Junkichi Ogawa; Isao Shimamura, all of Minami-ashigara, Japan

[73] Assignee: Fuji Photo Film Co., Ltd., Minami-ashigara, Japan

[21] Appl. No.: 902,139

[22] Filed: May 2, 1978

[30] Foreign Application Priority Data

May 2, 1977 [JP] Japan ..... 52-50909

[51] Int. Cl.[2] ..... G03C 7/00; G03C 1/06

[52] U.S. Cl. ..... 96/55; 96/66 R; 96/76 R; 96/95; 96/100 R

[58] Field of Search ..... 96/66 R, 95, 100 R, 96/76 R, 55

[56] References Cited

U.S. PATENT DOCUMENTS

| | | | |
|---|---|---|---|
| 2,930,693 | 3/1960 | Ganguin et al. | 96/66 R |
| 3,291,609 | 12/1966 | Porter et al. | 96/95 |
| 3,342,599 | 9/1967 | Reeves | 96/66 R |
| 3,705,035 | 12/1972 | Vetter et al. | 96/55 |
| 3,719,492 | 3/1973 | Barr et al. | 96/55 |

*Primary Examiner*—Travis J. Brown

*Attorney, Agent, or Firm*—Sughrue, Rothwell, Mion, Zinn and Macpeak

[57] ABSTRACT

A color photographic light-sensitive material comprising a support having thereon at least one silver halide emulsion layer, a non-diffusible color coupler present in at least one layer on the support and a layer containing at least one compound represented by the following general formula (I)

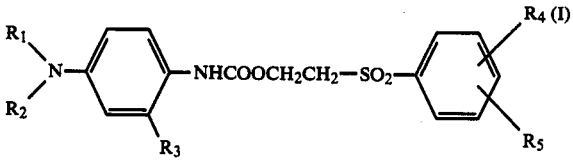

wherein $R_1$ represents an alkyl group, a hydroxyalkyl group, an alkoxyalkyl group or an alkylsulfonamidoalkyl group; $R_2$ represents an alkyl group, a hydroxyalkyl group, an alkoxyalkyl group or an alkylsulfonamidoalkyl group, $R_3$ represents a hydrogen atom, an alkyl group or an alkoxyalkyl group, and $R_4$ and $R_5$, which may be the same or different, each represents a hydrogen atom, a halogen atom, a carboxyl group, a sulfo group, a nitro group, a carboxylic acid ester group, an alkyl group or an alkoxyalkyl group.

6 Claims, No Drawings

COLOR PHOTOGRAPHIC LIGHT-SENSITIVE MATERIAL CONTAINING DEVELOPMENT PRECURSOR

BACKGROUND OF THE INVENTION

1. Field of the Invention

The present invention relates to color photographic light-sensitive materials. More particularly, the present invention relates to silver halide color photographic light-sensitive materials containing a precursor of a color developing agent.

2. Description of the Prior Art

A general process for forming color images comprises developing silver halide photographic light-sensitive materials using an aromatic primary amine developing agent in the presence of color couplers having the ability to form dyes by reacting with an oxidation product of the developing agent to form azomethine or indoaniline dyes. This color development process which was invented originally by L. D. Mannes and L. Godowsky in 1935 and which has been improved has now been used widely all over the world in the photographic field.

The processing of color photographic light-sensitive materials consists essentially of the following three steps:

(1) a color development step, (2) a bleaching step, (3) a fixing step.

The bleaching step and the fixing step may be carried out at the same time. Namely, a bleaching step (the so-called blix step), by which developed silver and undeveloped silver halide are removed can be used. In actual development processing, auxiliary steps for maintaining the photographic or physical quality of the images formed or for improving the storage stability of the images, etc. are employed in addition to the above described two essential steps consisting of color development and silver-removal. For example, baths such as a hardening bath for preventing an excessive softening of the light-sensitive layers during processing, a stopping bath for effectively stopping the development reaction, a stabilizing bath for stabilizing the images formed or a defilming bath for removing a backing layer on the support can be employed.

Usually, the aromatic primary amine developing agents are dissolved in an aqueous alkaline solution and used as a color developing solution. If the aromatic primary amine developing agent is incorporated in the light-sensitive material, the development can be carried out using only an aqueous alkaline solution. Consequently, the developing solution can be easily prepared and the composition of the developing solution changes to a lesser extent, so that handling of the developing solution can be easily carried out. Further, there are many advantages that the BOD of the waste liquor is decreased markedly and treatment of the waste liquor is easy. However, incorporation of an aromatic primary amine developing agent into a light-sensitive material, generally, has not be practically utilized yet, because many disadvantages such as desensitization of the light-sensitive material during storage, occurrence of fog or stains, or insufficient color formation in the processing, etc. occur.

Black-and-white developing agents such as hydroquinone or catechol, etc. can be incorporated into the light-sensitive materials in a comparatively stable state. For example, U.S. Pat. No. 3,295,978 discloses that these developing agents can be incorporated into the light-sensitive material as metal complex salts. On the other hand, aromatic primary amine developing agents are difficult to incorporate into the light-sensitive materials in a stable manner because of their lack of stability.

Prior art methods for incorporating aromatic primary amine developing agents into light-sensitive materials, are known. For example, U.S. Pat. No. 3,342,599 describes the use of Schiff bases of aromatic primary amine developing agents with salicylaldehyde as precursors of developing agents. U.S. Pat. No. 3,719,492 discloses the use of a combination of metal salts such as lead or cadmium salts with aromatic primary amine developing agents. In British Pat. No. 1,069,061 and U.S. Pat. No. 2,930,693, phthalimide type precursors prepared by reacting aromatic primary amines with phthalic acid are used. Additional known methods are described in German Pat. No. 1,159,758 and U.S. Pat. Nos. 3,419,395 and 3,705,035. However, all of the requirements of a formation of sufficient color density on development, a lack of desensitization on storage of the light-sensitive materials and the elimination of the occurrence of fog or stains can not be obtained using any of these prior art means.

SUMMARY OF THE INVENTION

An object of the present invention is to provide a method of incorporating a precursor of an aromatic primary amine developing agent into a light-sensitive material, which results in a high color density on development, less desensitization during storage of the light-sensitive material and little occurrence of fog or stains even though a precursor of an aromatic primary amine developing agent is incorporated into the light-sensitive material.

The object of the present invention has been attained by a color photographic light-sensitive material comprising a support having thereon at least one silver halide emulsion layer, a non-diffusible color coupler present in at least one layer on the support and a layer containing at least one compound represented by the following general formula (I)

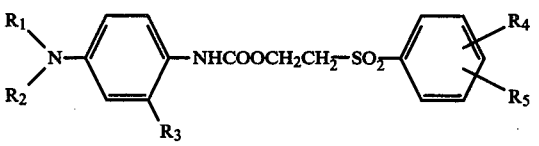

(I)

wherein $R_1$ represents an alkyl group having 1 to 5 carbon atoms, a hydroxyalkyl group having 1 to 5 carbon atoms, an alkoxyalkyl group having 2 to 10 total carbon atoms or an alkylsulfonamidoalkyl group having 2 to 10 total carbon atoms; $R_2$ represents an alkyl group having 1 to 5 carbon atoms, a hydroxyalkyl group having 1 to 5 carbon atoms, alkoxyalkyl group having 2 to 10 total carbon atoms or an alkylsulfonamidoalkyl group having 2 to 10 total carbon atoms; $R_3$ represents a hydrogen atom, an alkyl group having 1 to 5 carbon atoms or an alkoxyalkyl group having 2 to 5 total carbon atoms; $R_4$ represents a hydrogen atom, a halogen atom, a carboxyl group, a sulfo group, a nitro group, a carboxylic acid ester group having 2 to 5 total carbon atoms, an alkyl group having 1 to 5 carbon atoms or an alkoxyalkyl group having 2 to 5 total carbon atoms, and $R_5$ represents a hydrogen atom, a halogen atom, a carboxyl group, a sulfo group, a nitro group, a carboxylic acid ester group, an alkyl group having 1 to 5 carbon atoms or an alkoxyalkyl group having 2 to 5 total carbon atoms.

DETAILED DESCRIPTION OF THE INVENTION

As described above, $R_1$ represents an alkyl group having 1 to 5 carbon atoms (e.g., a methyl group, a butyl group, etc.), a hydroxyalkyl group having 1 to 5 total carbon atoms (e.g., a hydroxyethyl group, etc.), an alkoxyalkyl group having 2 to 10 total carbon atoms (e.g., an ethoxyethyl group, a methoxyethyl group, etc.) or an alkylsulfonamidoalkyl group having 2 to 10 total carbon atoms (e.g., an ethylsulfonamidoethyl group, a methylsulfonamidoethyl group, etc.); $R_2$ represents an alkyl group having 1 to 5 carbon atoms (e.g., a methyl group, a butyl group, etc.), a hydroxyalkyl group having 1 to 5 total carbon atoms (e.g., a hydroxyethyl group, etc.), an alkoxyalkyl group having 2 to 10 total carbon atoms (e.g., an ethoxyethyl group, a methoxyethyl group, etc.) or an alkylsulfonamidoalkyl group having 2 to 10 total carbon atoms (e.g., an ethylsulfonamidoethyl group, a methylsulfonamidoethyl group, etc.); $R_3$ represents a hydrogen atom, an alkyl group having 1 to 5 carbon atoms (e.g., a methyl group, a butyl group, etc.) or an alkoxyalkyl group having 2 to 5 total carbon atoms (e.g., an ethoxyethyl group, a methoxyethyl group, etc.); $R_4$ represents a hydrogen atom, a halogen atom (e.g., a chlorine atom, a bromine atom, etc.), a carboxyl group, a sulfo group, a nitro group, a carboxylic ester group having 2 to 5 total carbon atoms (e.g., a methoxycarbonyl group, a butoxycarbonyl group, etc.), an alkyl group having 1 to 5 carbon atoms (e.g., an ethyl group, etc.) or an alkoxyalkyl group having 2 to 5 total carbon atoms (e.g., a methoxymethyl group, an ethoxyethyl group, etc.); and $R_5$ represents a hydrogen atom, a halogen atom (e.g., a chlorine atom, a bromine atom, etc.), a carboxyl group, a sulfo group, a nitro group, a carboxylic ester group having 2 to 5 carbon atoms (e.g., a methoxycarbonyl group, a butoxycarbonyl group, etc.), an alkyl group having 1 to 5 carbon atoms (e.g., an ethyl group, etc.) or an alkoxyalkyl group having 2 to 5 total carbon atoms (e.g., a methoxymethyl group, an ethoxyethyl group, etc.). The alkyl groups and alkyl moieties for the $R_1$, $R_2$, $R_3$, $R_4$ and $R_5$ groups described above are preferably straight chained groups and moieties.

Specific examples of compounds represented by the general formula (I) above which can be used in the present invention are described below. However, the present invention is not to be construed as being limited to these compounds only.

| Compound | Chemical Formula |
|---|---|
| (1) | 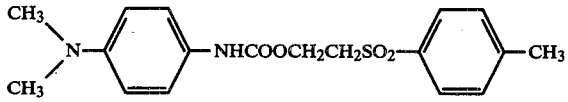 |
| (2) | 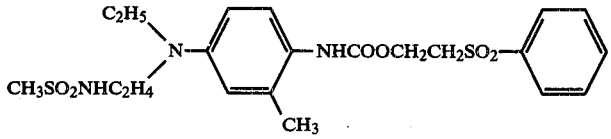 |
| (3) | 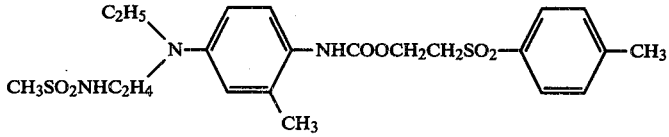 |
| (4) | 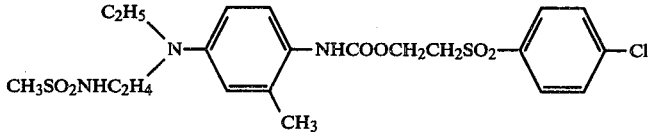 |
| (5) | 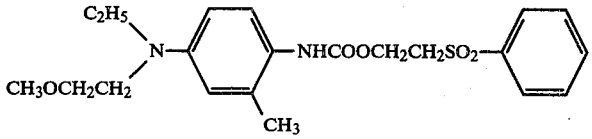 |
| (6) | 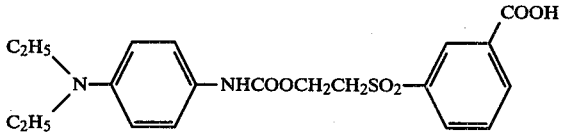 |
| (7) | 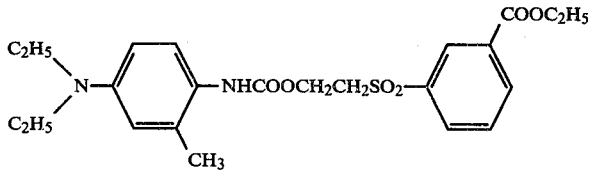 |

-continued

| Compound | Chemical Formula |
|---|---|
| (8) | 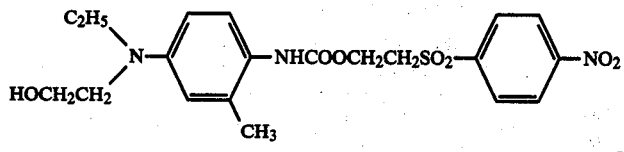 |
| (9) | 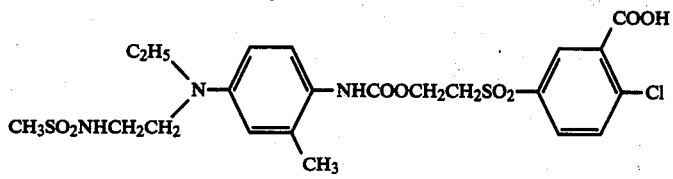 |

The compound represented by the general formula (I) above undergoes hydrolysis in an aqueous alkaline solution as follows

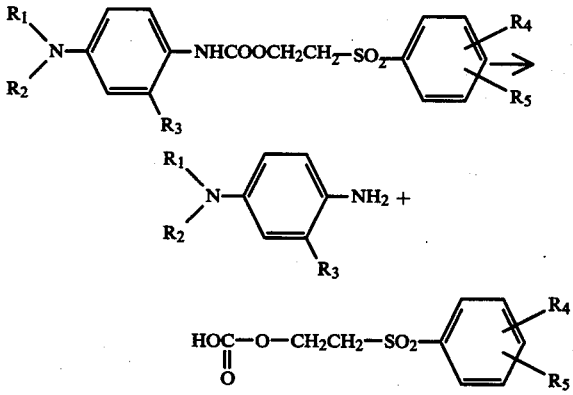

wherein $R_1$ to $R_5$ are as described above and the organic amine moiety

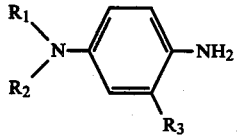

serves as a developing agent.

The developing agent moiety (the organic amine moiety) of the precursors comprises a p-phenylenediamine derivative, typical examples of which include N,N-diethyl-p-phenylenediamine, 2-amino-5-diethylaminotoluene, 2-amino-5-(N-ethyl-N-lauryl-)aminotoluene, 4-[N-ethyl-N-(β-hydroxyethyl-)amino]aniline, 2-methyl-4-[N-ethyl-N-(β-hydroxyethyl)amino]aniline, N-ethyl-N-(β-methanesulfonamidoethyl)-3-methyl-4-aminoaniline as described in U.S. Pat. No. 2,193,015, N-(2-amino-5-diethylaminophenylethyl)-methanesulfonamide as described in U.S. Pat. No. 2,592,364 and 4-amino-3-methyl-N-ethyl-N-methoxyethylaniline, 4-amino-3-methyl-N-ethyl-N-β-ethoxyethylaniline and 4-amino-3-methoxy-N-ethyl-N-β-butoxyethylaniline as described in U.S. Pat. Nos. 3,656,950 and 3,698,525, etc. In addition, examples include the compounds described in *Kagakushashin Binran,* vol. 2, page 72, Maruzen Co., (1959) and L. F. A. Mason *Photographic Processing Chemistry,* pages 226–229, Focal Press, London (1966).

These compounds can be synthesized using the following process. Unless otherwise indicated herein, all parts, percents, ratios and the like are by weight.

SYNTHESIS EXAMPLE 1

Synthesis of Compound (2)

3-Methyl-4-(2-benzenesulfonyl)ethoxycarbonylamino-N-ethyl-N-methanesulfonylaminoethyl-aniline [Compound (2)]

(1) Synthesis of 2-Benzenesulfonylethanol.

200 g of sodium benzenesulfinate was dissolved in 500 ml of water and the solution was heated to 80°–90° C. After simultaneously adding dropwise 21 g of sodium hydroxide to 50 ml of water and 134 ml of ethylene chlorohydrin over a period of about an hour and a half, the mixture was stirred for 2 hours at the same temperature as described above. After cooling, the mixture was extracted with 500 ml of ethyl acetate and the extract dried using magnesium sulfate.

After separating the magnesium sulfate by filtration and removing the solvent by distillation, the residue was distilled under a reduced pressure to obtain the object compound.

Yield: 140 g (b.p. 174° C./1 mm Hg).

(2) Synthesis of 3-Methyl-4-(2-benzenesulfonyl)ethoxycarbonylamino-N-ethyl-N-methanesulfonylaminoethyl-aniline [Compound (2)]

27.1 g of 4-amino-3-methyl-N-ethyl-N-methanesulfonylaminoethylaniline and 8 g of pyridine were dissolved in 100 ml of acetonitrile, and 15.6 g of phenyl chloroformate was added dropwise thereto while maintaining the temperature at 10° C.

After stirring the mixture at room temperature (about 20°–30° C.) for an hour after the addition, 500 ml of ice-water was added thereto. The mixture was then extracted with 500 ml of ethyl acetate and the extract dried over magnesium sulfate.

After separating magnesium sulfate by filtration, the solvent was removed by distillation to obtain 33 g of an oily compound. Then, 15.6 g of 2-benzenesulfonylethanol obtained in part (1) above was added to the oily compound. The mixture was heated at 150° C. and the formed phenol was removed by distillation under a reduced pressure. After heating at the same temperature as described above for about 3 hours, the residue was cooled to room temperature and recrystallized from 1 liter of ethanol.

Yield: 30 g (m.p. 87°–89° C.).

Elemental Analysis as $C_{21}H_{29}N_3O_6S_2$: Found (%): C: 51.96; H: 6.08; N: 8.78. Calculated (%): C: 52.15; H: 6.04; N: 8.69.

SYNTHESIS EXAMPLE 2

Synthesis of Compound (4)

3-Methyl-4(2-(p)chlorobenzenesulfonyl)ethoxycarbonylamino-N-ethyl-N-methanesulfonylaminoethylaniline [Compound (4)]

A mixture of 11.0 g of 2-(p)chlorobenzenesulfonylethanol obtained by the same process as in part (1) of Synthesis Example 1 above and 20.0 g of 3-methyl-4-phenoxycarbonylamino-N-ethyl-N-methanesulfonylaminoethyl-aniline was heated to 150° C., while the formed phenol was removed by distillation under a reduced pressure. After heating for 3 or more hours, when it had been confirmed that no additional phenol was forming, the mixture was cooled to room temperature and recrystallized from 300 ml of ethanol.

Yield: 20 g (m.p. 119°–120° C.).

Elemental Analysis as $C_{21}H_{28}ClN_3O_6S$: Found (%): C: 48.32; H: 5.42; N: 8.29. Calculated (%): C: 48.69; H: 5.45; N: 8.11.

Other compounds can be synthesized in the same manner as described in Synthesis Examples 1 and 2 above.

The compounds represented by the general formula (I) above may be dispersed in hydrophilic colloid solutions directly where the compounds are water soluble or the compounds may be dispersed in hydrophilic colloid solutions using latexes or other polymers or using an oil/water emulsion type dispersion method. Where the compounds are not water-soluble. Examples of oils which can be used for the oil/water emulsion type dispersion method, include oils for dissolving couplers used for oil protect-type light-sensitive materials. For example, tri-o-cresyl phosphate, trihexyl phosphate, dioctyl butyl phosphate, dibutyl phthalate, diethyllaurylamide, 2,4-diallyl phenol and octyl benzoate, etc., can be used.

In order to disperse an oil phase with the compounds dissolved therein into an aqueous phase, conventional surface active agents can be used. For example, anionic surface active agents having acid groups such as carboxylic acid, sulfonic acid, phosphoric acid, sulfuric acid ester or phosphoric acid ester groups, etc. and nonionic, cationic or ampholytic surface active agents can be used.

Suitable hydrophilic colloids which can be used include materials known as photographic binders, including gelatin. For example, various kinds of synthetic high molecular weight materials, such as gelatin derivatives, graft polymers of gelatin with other high molecular weight materials, cellulose derivatives such as hydroxyethylcellulose, carboxymethylcellulose or cellulose sulfate, etc., sodium alginate, starch derivatives, and homo- or copolymers such as polyvinyl alcohol partial acetal, poly-N-vinylpyrrolidone, polyacrylic acid, polymethacrylic acid, polyacrylamide, polyimidazole or polyvinyl butyral, etc., can be used. In some cases, latexes may be employed. Examples of these binders include the compounds described in U.S. Pat. No. 3,518,088 and *Research Disclosure* August 1976, No. 148–14850.

Further, it is possible to employ known photographic antioxidants or stabilizers in the emulsions. For example, hydroquinone derivatives, reductones such as ascorbic acid, hydroxylamines, sulfonyl compounds or active methylene compounds can be employed in the emulsions.

The amount of the precursor of the color developing agent used in the present invention is about 0.1 to about 10 molar times and preferably 0.25 to 5 molar times, the total amount of silver per unit area of the light-sensitive material. The precursor of the color developing agent may be incorporated into photosensitive layers containing a silver halide emulsion or into other layers. Preferably, the precursor of the color developing agent is incorporated into a layer different from the light-sensitive layer.

Conventional exposure procedures (e.g., using light from a 500 W tungsten lamp at a color temperature of 2854° K. at 500 lux for 1 second) can be used in this invention.

The development processing used for the color photographic light-sensitive material of the present invention is the same as the prior art color development processing except that the color developing bath is an alkaline activator bath.

A suitable pH for the activator bath ranges from about 7 to 14 and particularly from about 8 to 13. A suitable temperature at which the activator bath can be used ranges from about 20° to 70° C., but a preferred range is 30° to 60° C.

A suitable activator bath used in the present invention is a bath which is the same as a conventional color developing solution but which does not contain a color developing agent. Suitable buffer agents which can be present in the activator bath are sodium hydroxide, potassium hydroxide, sodium carbonate, potassium carbonate, sodium tertiary phosphate, potassium tertiary phosphate, potassium metaborate and borax, etc., which may be used individually or as a combination thereof. Further, it is possible to use various salts such as disodium hydrogen phosphate, dipotassium hydrogen phosphate, sodium dihydrogen phosphate, potassium dihydrogen phosphate, sodium bicarbonate, potassium bicarbonate, boric acid, alkali metal nitrates or alkali metal sulfates, etc. in order to provide a buffering capability, for reasons of reducing preparation errors or for the purpose of increasing the ionic strength.

Moreover, antifogging agents can be incorporated into the activator bath in a suitable amount. Suitable antifogging agents include inorganic halide compounds and known organic antifogging agents. Typical examples of inorganic halide compounds include bromides such as sodium bromide, potassium bromide or ammonium bromide, etc. and iodides such as potassium iodide or sodium iodide, etc. Examples of organic antifogging agents include 6-nitrobenzimidazole as described in U.S. Pat. No. 2,496,940, 5-nitrobenzimidazole as described in U.S. Pat. Nos. 2,497,917 and 2,656,271, diaminophenazine and o-phenylenediamine as described in *Nippon Shashingakkaishi*, vol. 11, page 48 (1948) and heterocyclic compounds such as mercaptobenzimidazole, methylbenzothiazole, mercaptobenzoxazole, thiouracil, 5-methylbenzotriazole or the compounds described in Japanese Patent Publication No. 41,675/71, etc. In addition, the antifogging agents described in *Kagakushashin Binran* vol. 2, page 119 Maruzen Co., (1959) may be used too.

In order to control surface layer development, the development restrainers described in Japanese Patent Publications Nos. 19,039/71 and 6,149/70 and U.S. Pat. No. 3,295,976, etc. can also be used.

In addition, if desired, ammonium chloride, potassium chloride or sodium chloride may be present in the accelerator bath. Further, if desired, suitable development accelerators may be used in combination. Examples of development accelerators include pyridinium compounds as disclosed in U.S. Pat. No. 2,648,604, Japanese Patent Publication No. 9,503/69 and U.S. Pat. No. 3,671,247 and other cationic compounds, cationic dyes such as phenosafranine, neutral salts such as thallium nitrate or potassium nitrate, nonionic compounds such as polyethylene glycol or derivatives thereof or polythioethers, as described in Japanese Patent Publication No. 9504/69 and U.S. Pat. Nos. 2,533,990, 2,531,832, 2,950,970 and 2,577,127, organic solvents and organic amines as described in Japanese Patent Publication No. 9,509/69 and Belgian Pat. No. 682,862, ethanolamine, ethylenediamine and diethanolamine. In addition, development accelerators as described in L. F. A. Mason *Photographic Processing Chemistry* pages 40–43, Focal Press, London (1966).

Further, benzyl alcohol and phenethyl alcohol described in U.S. Pat. No. 2,304,925 and pyridine, ammonia, hydrazine and amines described in *Nippon Shashingakkaishi,* 14, 74 (1952) can be used as effective development accelerators in some cases.

Further, it is also possible to employ sodium sulfite, potassium sulfite, potassium bisulfite or sodium bisulfite in the accelerator bath.

Moreover, water softeners, for example, polyphosphoric acid compounds such as sodium hexametaphosphate, sodium tetrapolyphosphate or sodium tripolyphosphate, or potassium salts of hexametaphosphoric acid, tetrapolyphosphoric acid or tripolyphosphoric acid, etc. and aminopolycarboxylic acids such as ethylenediaminetetraacetic acid, nitrilotriacetic acid, cyclohexanediaminetetraacetic acid, iminodiacetic acid, N-(hydroxymethyl)ethylenediaminetriacetic acid or diethylenetriamine pentaacetic acid, etc. in the accelerator bath. Although an amount of these water-softeners will vary depending on the hardness of the water used, generally about 0.5 to 10 g/liter is suitable. In addition to this, calcium or magnesium sequestering agents may be used. Compounds of this type are described in J. Willems *Belgisches Chemiches Industry,* 21, page 325 (1956) and ibid., 23, page 1105 (1958).

If desired, organic solvents can also be employed in the accelerator bath.

Examples of suitable organic solvents include, ethylene glycol, hexylene glycol, diethylene glycol, methyl Cellosolve, methanol, ethanol, acetone, triethylene glycol, dimethylformamide, dimethylsulfoxide and the compounds described in Japanese Patent Publications Nos. 33378/72 and 9509/69.

Although an amount of the organic solvents can vary over a wide range depending on the composition of the activator bath, a suitable amount is generally less than about 50% by volume and usually less than 10% by volume of the solution used. Further, substantially anhydrous solvents can be sometimes used as the solvent for the activator bath.

Auxiliary developing agents such as N-methyl-p-aminophenol hemisulfate (Metol), benzyl-p-aminophenol hydrochloride, N,N-diethyl-p-aminophenol hydrochloride, p-aminophenol sulfate, phenidone and N,N,N',N'-tetramethyl-p-phenylenediamine hydrochloride, etc., can also be used. A preferred amount of the auxiliary developing agent is generally about 0.01 to 1.0 g/liter of the activator bath.

In addition, the following materials can also be employed, if necessary, in the activator bath.

For example, competing couplers (uncolored couplers) such as citrazinic acid, J-acid or H-acid, e.g., as described in Japanese Patent Publications Nos. 9,509/69, 9,506/69, 9,507/69, 14,036/70 and 9,508/69 and U.S. Pat. Nos. 2,742,832, 3,520,609, 3,560,212 and 3,645,737 can be used.

Fogging agents such as alkali metal borohydrides, aminoboranes or ethylenediamine as described in Japanese Patent Publication No. 38,816/72 can be employed.

In color photographic light-sensitive materials wherein compounds which form a dye by reacting with oxidized developing agent, the so-called couplers, are incorporated in light-sensitive photographic emulsion layers, the development agent precursor compound used in the present invention may be added to the same layer as or a different layer than the above described layers.

Such a structure is a particularly advantageous embodiment of the present invention. Such color couplers have a chemical structure such that they do not diffuse into other layers during production or during processing.

Open chain diketomethylene type compounds are widely used in general as yellow couplers. Examples of suitable yellow couplers are described in, for example, U.S. Pat. Nos. 3,341,331, 2,875,057 and 3,551,155, German patent application (OLS) No. 1,547,868, U.S. Pat. Nos. 3,265,506, 3,582,322 and 3,725,072, German patent application (OLS) No. 2,162,899, U.S. Pat. Nos. 3,369,895 and 3,408,194 and German patent applications (OLS) Nos. 2,057,941, 2,213,461, 2,219,917, 2,261,361 and 2,263,875, etc.

Although 5-pyrazolone type compounds are mainly used as magenta couplers, imidazolone type compounds and cyanoacetyl compounds can also be used as magenta couplers. Examples of suitable magenta couplers are described in, for example, U.S. Pat. Nos. 2,439,098, 2,600,788, 3,062,653 and 3,558,319, British Pat. No. 956,261, U.S. Pat. Nos. 3,582,322, 3,615,506, 3,519,429, 3,311,476 and 3,419,391, Japanese patent applications Nos. 21,454/73 and 56,050/73, German Pat. No. 1,810,464, Japanese Patent Publication No. 2,016/69, Japanese patent application No. 45,971/73 and U.S. Pat. No. 2,983,608, etc.

Phenol or naphthol derivatives are mainly used as cyan couplers. Examples of suitable cyan couplers are described in, for example, U.S. Pat. Nos. 2,369,929, 2,474,293, 2,698,794, 2,895,826, 3,311,476, 3,458,315, 3,560,212, 3,582,322, 3,591,383, 3,386,301, 2,434,272, 2,706,684, 3,034,892 and 3,583,971, German patent application (OLS) No. 2,163,811, Japanese Patent Publication No. 28,836/70 and Japanese patent application No. 33,238/73, etc.

Representative examples of color couplers which can be used in the present invention include the following compounds

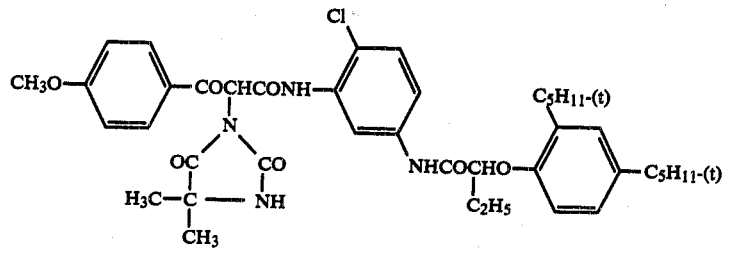

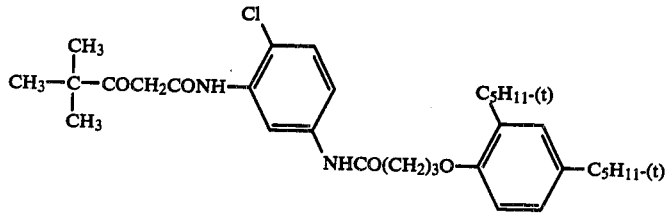

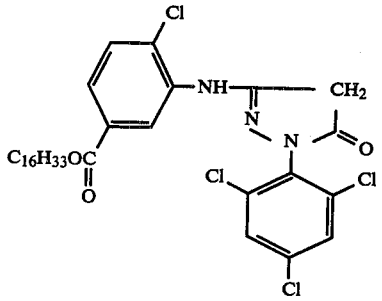

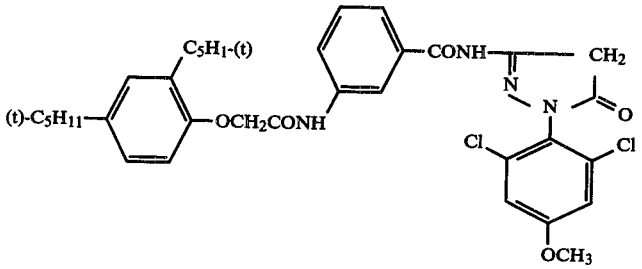

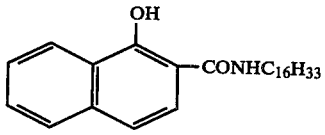

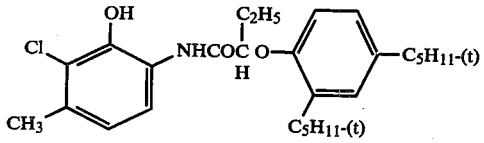

A suitable amount of color coupler which can be used in the present invention is about 0.02 to about 1 mol per mol of silver halide, preferably 0.03 to 0.5 mole per mol of silver halide.

Further, it is possible to incorporate development inhibiting compound releasing type couplers (the so-called DIR couplers) compounds which release a development inhibiting compound at color coupling into the photographic material. Examples of suitable DIR couplers are described in U.S. Pat. Nos. 3,148,062, 3,227,554, 3,253,924, 3,617,291, 3,622,328 and 3,705,201, British Pat. No. 1,201,110 and U.S. Pat. Nos. 3,297,445, 3,379,529 and 3,639,417, etc.

Two or more of the above described couplers can be employed in the same layer depending on the characteristics required for the light-sensitive material. Of course, the same compound may be employed in two or more different layers, if desired.

Preferably, the couplers are insoluble in water and are mixed with a coupler solvent (preferably, a coupler solvent having a suitable polarity). Typical useful coupler solvents are tri-o-cresyl phosphate, dibutyl phthalate, diethyl laurylamide, 2,4-diallylphenol and liquid dye stabilizers described as "improved photographic dye image stabilizing solvents" in *Product Licensing Index*, vol. 83, pages 26–29 (March 1971).

Preferably the maximum adsorption region of the cyan dyes is in the range of about 600 to 680 nm, that of the magenta dyes is in the range of about 500 to 580 nm and that of the yellow dyes is in the range of about 400 to 480 nm.

The silver halide emulsions used in this invention can, in general, be produced by mixing a solution of a water soluble silver salt (for example, silver nitrate) with a solution of a water soluble halogen salt (for example, potassium bromide) in the presence of a solution of a water soluble high molecular weight material such as gelatin. Not only silver chloride and silver bromide but also mixed silver halides such as silver bromochloride, silver iodobromide or silver iodobromochloride, etc. may be used as the silver halides.

The grains of these silver halide may have any shape such as a cubic form, an octahedral form and a mixed crystal form thereof.

The grains of these silver halides can be produced using known conventional methods, such as by the so-called single or double jet process or the controlled double jet process.

Suitable photographic emulsions are described in C. E. K. Mees & T. H. James *The Theory of the Photographic Process*, MacMillan Co. New York (1966) and P. Glaflides *Chimie Photographique*, Paul Montel, Paris (1957) and they can be prepared by an ammonia method, a neutral method or an acid method.

After formation of the silver halide grains, the grains are washed with water to remove by-produced water soluble salts (for example, potassium nitrate in the case of producing silver bromide using silver nitrate and potassium bromide) from the system, and they are then heated in a presence of a chemical sensitizing agent (for example, sodium thiosulfate, N,N,N'-trimethylthiourea, monovalent gold-thiocyanate complex salt, thiosulfate complex salt, stannous chloride and hexamethylenetetramine, etc.) to increase the sensitivity without increasing the grain size. This process has been described in Mees & James, supra and Glaflides, supra.

The above-described silver halide emulsion may be chemically sensitized using conventional techniques. Examples of suitable chemical sensitizing agents which can be used include gold compounds (for example, chloroaurate or gold trichloride) as described in U.S. Pat. Nos. 2,399,083, 2,540,085, 2,597,856 and 2,597,915, salts of noble metals (for example, platinum, palladium, iridium, rhodium or ruthenium, etc.) as described in U.S. Pat. Nos. 2,448,060, 2,540,086, 2,566,245, 2,566,263 and 2,598,079, sulfur compounds which form silver sulfide by reacting with silver salts, as described in U.S. Pat. Nos. 1,574,944, 2,410,689, 3,189,458 and 3,501,313, and reducing agents (for example, stannous salts and amines, etc.) as described in U.S. Pat. Nos. 2,487,850, 2,518,698, 2,521,925, 2,521,926, 2,694,637, 2,983,610 and 3,201,254, etc.

Antifogging agents for silver halide may be added to the photosensitive layers of the photographic light-sensitive material of this invention. Typical antifogging agents which can be used are heterocyclic organic compounds such as tetrazole, azaindene or triazoles, etc. and aromatic or heterocyclic compounds having a mercapto group.

The layers of the photographic light-sensitive materials of the present invention may contain hardening agents, plasticizers, lubricating agents, surface active agents, lustering agents and other additives commonly used in the photographic field.

Examples of hydrophilic colloids which can be used include gelatin, colloidal albumin, casein, cellulose derivatives such as carboxymethyl cellulose or hydroxyethyl cellulose, etc., saccharide derivatives such as agar, sodium alginate or starch derivatives, etc. and synthetic hydrophilic colloids such as polyvinyl alcohol, poly-N-vinylpyrrolidone, acrylic acid polymers, polyacrylamide, derivatives thereof or partially hydrolyzed products thereof, etc. If desired, a compatible mixture of two or more of these colloids can be used. Of these colloids, although gelatin is the most generally used, a part or all of the gelatin may be replaced by not only synthetic high molecular materials but also by gelatin derivatives, namely, materials produced by treating gelatin with a compound having a group capable of reacting with the amino groups, imino groups, hydroxy groups or carboxyl groups as functional groups in the gelatin molecule, or graft polymers obtained by grafting the chains of other high molecular weight materials onto gelatin.

The photographic emulsions may be, if desired, spectrally sensitized or supersensitized using one or more cyanine dyes such as cyanine, merocyanine or hamicyanine dyes, etc. or using cyanine dyes together with styryl dyes. These color sensitization techniques are known and are described in, for example, U.S. Pat. Nos. 2,493,748, 2,519,001, 2,977,229, 3,480,434, 3,672,897, 3,703,377, 2,688,545, 2,912,328, 3,397,060, 3,615,635 and 3,628,964, British Pat. Nos. 1,195,302, 1,242,588 and 1,293,862, German patent applications (OLS) Nos. 2,030,326 and 2,121,780, Japanese Patent Publications Nos. 4,936/68, 14,030/69 and 10,773/68, U.S. Pat. Nos. 3,511,664, 3,522,052, 3,527,641, 3,615,613, 3,615,632, 3,617,295, 3,635,721 and 3,694,217 and British Pat. Nos. 1,137,580 and 1,216,203. Selection of suitable dyes can be made depending on the purpose or use of the light-sensitive materials, such as the wavelength range to be sensitized or the sensitivity desired, etc.

These photographic emulsions are applied to planar materials which do not undergo a marked dimensional change during processing, for example, rigid supports such as glass, metal or porcelain or flexible supports, depending on the end-use. A suitable coated amount of silver halide is preferably 0.1 to 10 $gAg/m^2$, most preferably 0.5 to 8 $gAg/m^2$, of the support. Typical examples of flexible supports, are cellulose nitrate films, cellulose acetate films, cellulose acetate butyrate films, cellulose acetate propionate films, polystyrene films, polyethylene terephthalate films polycarbonate films and laminates of these resins, thin glass films and paper, etc. which are used usually for photographic light-sensitive materials. Good results are also obtained using paper coated or laminated with baryta or $\alpha$-olefin polymers, particularly, polymers of an $\alpha$-olefin having 2 to 10 carbon atoms, such as polyethylene, polypropylene or ethylene-butene copolymers, etc., and synthetic resin films the surface of which has been roughed as described in Japanese Patent Publication No. 19,068/72 to improve adhesiveness to other high molecular weight materials and to improve printability.

Transparent supports or opaque supports can be selected from the above-described supports depending on the use of the light-sensitive materials. As transparent supports, not only colorless transparent supports but also colored transparent supports obtained by adding dyes or pigments to a transparent support may be used.

Use of colored transparent supports for X-ray films is described in *J. SMPTE,* 67, 296 (1958).

Examples of opaque supports which can be used include not only intrinsically opaque supports such as paper but also films obtained by adding dyes of pigments such as titanium oxide to transparent films, synthetic resin films the surface of which has been processed in the manner described in Japanese Patent Publication No. 19,068/72 and paper or synthetic resin films to which carbon black or dyes have been added to render them completely light shielding. Where the adhesive strength between the support and the photographic emulsion layer is insufficient, a layer which is adhesive to both of the support and the emulsion layer is employed as a subbing layer. Further, in order to further improve the adhesive property, the surface of the supports may be subjected to preliminary treatment such as a corona discharge treatment, an ultraviolet light treatment or flame treatment, etc.

As described above, the color photographic light-sensitive materials used in the present invention comprise a support and dye image providing unit layers on the support. Multilayer color photographic light-sensitive materials for providing multicolor images have at least two dye images providing unit layers wherein each layer first records light having a certain wavelength range. The unit layers contain a light-sensitive silver salt which is generally sensitive to light having a certain wavelength range and is usually combined with a photographic coupler. In order to prevent the occurrence of any color mixing between the dye image supplying unit layers, the unit layers are effectively separated by a barrier layer, a spacer layer, a layer containing an agent for removing the oxidation products of developing agents or another layer. Methods of effectively separating the unit layers are known in the photographic field and have been utilized in many commercial color light-sensitive materials. Further, light-sensitive materials having a layer for preventing development contamination as described in U.S. Pat. No. 3,737,317 and Japanese Pat. application Nos. 73,445/73 and 113,633/73 can be used for the present invention.

The present invention provides excellent advantages as compared with the prior methods. Some of these advantages are described below.

First, less fogging occurs.

Second, a residual color is not formed on the processed light-sensitive materials, because the precursor used in the present invention is colorless after processing with the activator bath.

Third, unprocessed light-sensitive materials have good stability with the lapse of time.

The following examples are given to illustrate the present invention in greater detail.

EXAMPLE 1

A color paper was produced by coating a silver bromide emulsion layer containing a yellow coupler emulsified dispersion, a silver bromochloride (silver chloride; 70% by mol) emulsion layer containing a magenta coupler emulsified dispersion, a silver bromochloride (silver chloride: 70% by mol) emulsion layer containing a cyan coupler emulsified dispersion and a gelatin layer containing an ultraviolet light absorbing agent on a paper support coated with polyethylene. Each coupler emulsified dispersion used for this color paper was produced by dissolving each coupler in a mixture of dibutyl phthalate and tricresyl phosphate and dispersing the solution in a gelatin solution using sodium dodecylbenzene sulfonate as an emulsifying agent to form an O/W emulsion.

2-[α-(2,4-Di-t-amylphenoxy)butanamido]-4,6-dichloro-5-methylphenol was used as the cyan coupler. 1-(2,4,6-Trichlorophenyl)-3-(2-chloro-5-tetradecanamido)anilino-2-pyrazoline-5-one was used as the magenta coupler. α-Pivaloyl-α-(2,4-dioxo-5,5'-dimethyloxazolidin-3-yl)-2-chloro-5-[α-(2,4-di-t-amylphenoxy)butanamide] was used as the yellow coupler. Compound (5) described Japanese Patent Publication No. 9,586/70 having the formula

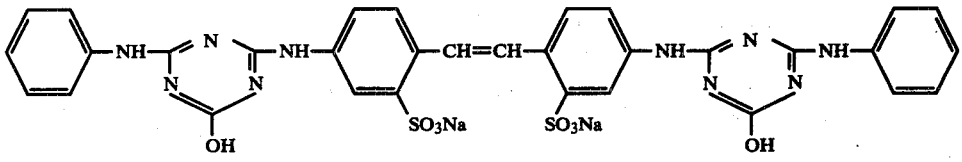

was used as the ultraviolet light absorbing agent. 2,4-Dichloro-6-hydroxy-1,3,5-triazine sodium salt was used as the antifogging agent for the emulsion.

The amounts of the couplers and the silver salts present in this color paper were as follows.

| Layer | Amount of Coupler ($g/m^2$) | Amount of Silver Salt ($gAg/m^2$) |
|---|---|---|
| Red-sensitive Layer | 0.4 | 0.30 |
| Green-sensitive Layer | 0.4 | 0.45 |
| Blue-sensitive Layer | 0.5 | 0.40 |

A layer of a developing agent precursor was provided as a top layer. The precursor was coated as an emulsified dispersion in an equimolar amount to the total amount of silver in the same area.

After this photographic element was exposed to light (1 second, 500 C.M.S.) using a sensitometer, the following processing was carried out.

| Processing Step | Temperature (°C) | Time |
|---|---|---|
| Activator Development | 50 | 1 minute |
| Bleaching-Fixing | " | 1 minute and 30 seconds |
| Water Wash | " | 2 minutes |
| Stabilizing | " | 1 minutes |

The processing solutions used had the following compositions.

| Activator Solution | |
|---|---|
| Benzyl Alcohol | 14 ml |
| Sodium Sulfite | 2 g |
| Potassium Bromide | 0.5 g |
| Sodium Carbonate (monohydrate) | 30 g |
| Water to make | 1 liter |

-continued

| | |
|---|---|
| **Bleach-Fixing Solution** | |
| Ammonium Thiosulfate (70% aq. soln.) | 150 ml |
| Sodium Sulfite | 5 g |
| Na[Fe(III)(EDTA)] | 40 g |
| EDTA | 4 g |
| Water to make | 1 liter |
| (EDTA: Ethylenediaminetetraacetic acid) | |
| **Stabilizing Solution** | |
| Glacial Acetic Acid | 10 ml |
| Sodium Acetate | 5 g |
| Formaldehyde (37% aq. soln.) | 5 ml |
| Water to make | 1 liter |

The results obtained are shown in Table 1 below.

Table 1

| Sample No. (compound used) | Photographic Properties Immediately after Coating | | | | | | | | |
|---|---|---|---|---|---|---|---|---|---|
| | Fog | | | Relative Sensitivity (logarithmic scale) | | | Maximum Density | | |
| | R** | G | B | R | G | B | R | G | B |
| 1 Comparison* | 0.30 | 0.51 | 2.00 | 0.81 | -*** | -*** | 1.90 | 1.62 | 2.00 |
| 2 Compound (1) | 0.17 | 0.17 | 0.15 | 0.85 | 1.00 | 0.91 | 0.60 | 0.95 | 0.65 |
| 3 Compound (2) | 0.19 | 0.19 | 0.16 | 1.05 | 1.34 | 1.55 | 1.33 | 1.78 | 0.80 |
| 4 Compound (3) | 0.18 | 0.18 | 0.16 | 0.90 | 0.82 | 0.62 | 0.62 | 0.80 | 0.60 |
| 5 Compound (5) | 0.18 | 0.19 | 0.18 | 0.98 | 1.28 | 1.45 | 0.78 | 1.12 | 0.75 |

*The following compound described in U.S. Patent 3,342,599 was used for comparison.

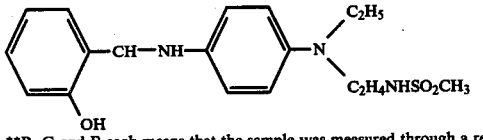

**R, G and B each means that the sample was measured through a red, green or blue filter.
*** Measurement was impossible because the degree of fogging was too high.

Although it has been believed in the art that the compound used for comparison is the best for color development, this compound has the defect that it has a yellow color per se and the processed light-sensitive material suffers from a high degree of yellow fogging when the compound remains without being decomposed. However, the compounds of the present invention do not give rise to any coloration. Further, it can be seen that the compounds of the present invention cause less fogging to occur and comparatively high maximum color densities are obtained when they are used.

Table 2

| Sample No. | Forced Deterioration Conditions | Photographic Properties after Forced Deterioration Testing | | | | | | | | |
|---|---|---|---|---|---|---|---|---|---|---|
| | | Fog | | | Relative Sensitivity (logarithmic scale) | | | Maximum Density | | |
| | | R** | G | B | R | G* | B* | R | G | B |
| 6 Sample No.1 | Immediately after coating** | 0.30 | 0.51 | 2.00 | 1.81 | — | — | 1.90 | 1.62 | 2.00 |
| 7 Sample No.1 | 50° C. dry***, for 2 days | 0.32 | 0.55 | 2.10 | 0.80 | — | — | 1.70 | 1.54 | 2.10 |
| 8 Sample No.1 | 50° C., 80% RH, for 2 days | 0.43 | 0.71 | 2.42 | 0.72 | — | — | 1.10 | 0.98 | 2.42 |
| 9 Sample No.3 | Immediately after coating** | 0.19 | 0.19 | 0.16 | 1.05 | 1.34 | 1.55 | 1.33 | 1.78 | 0.80 |
| 10 Sample No.3 | 50° C. dry, for 2 days | 0.20 | 0.20 | 0.17 | 1.01 | 1.35 | 1.54 | 1.16 | 1.79 | 0.80 |
| 11 Sample No.3 | 50° C., 80% RH, for 2 days | 0.21 | 0.22 | 0.28 | 1.05 | 1.40 | 1.63 | 1.14 | 1.73 | 0.78 |

*Measurement was impossible because of the high degree of fogging.
**Sample stored for 3 days after coating at room temperature.
***Dry means that the air in an airtight system was elevated to the temperature indicated from room temperature.

Table 2 shows stability with the lapse of time of the unprocessed light-sensitive materials.

It can be seen from the results obtained in the forced deterioration testing that the increase in fogging, the decrease in sensitivity and the reduction of maximum densities of the sample of the present invention are all smaller than those of the comparison sample. Further, the stability with the lapse of time of the sample using the compound of the present invention is superior to that of the comparison sample, and the maximum densities after the lapse of time are nearly the same, which means that a disadvantage of the present invention that maximum densities just after application are low is substantially removed.

While the invention has been described in detail and with reference to specific embodiments thereof, it will be apparent to one skilled in the art that various changes and modifications can be made therein without departing from the spirit and scope thereof.

What is claimed is:

1. A color photographic light-sensitive material comprising a support having thereon at least one silver halide emulsion layer, a non-diffusible color coupler present in at least one layer on the support and a layer containing at least one compound represented by the following general formula (I)

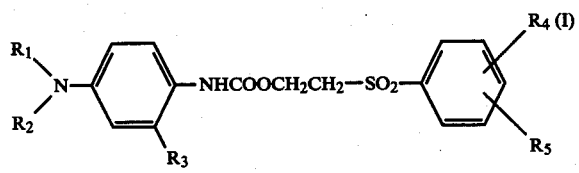

wherein $R_1$ is an alkyl group having 1 to 5 carbon atoms, a hydroxyalkyl group having 1 to 5 carbon atoms, an alkoxyalkyl group having 2 to 10 total carbon atoms or an alkylsulfonamidoalkyl group having 2 to 10 total carbon atoms; $R_2$ represents an alkyl group having 1 to 5 carbon atoms, a hydroxyalkyl group having 1 to 5 carbon atoms, an alkoxyalkyl group having 2 to 10 total carbon atoms or an alkylsulfonamidoalkyl group having 2 to 10 total carbon atoms; $R_3$ represents a hydrogen atom, an alkyl group having 1 to 5 carbon atoms or an alkoxyalkyl group having 2 to 5 total carbon atoms; $R_4$ represents a hydrogen atom, a halogen atom, a carboxyl group, a sulfo group, a nitro group, a carboxylic acid ester group having 2 to 5 total carbon atoms, an alkyl group having 1 to 5 carbon atoms or an alkoxyalkyl group having 2 to 5 total carbon atoms; and $R_5$ represents a hydrogen atom, a halogen atom, a carboxyl group, a sulfo group, a nitro group, a carboxylic acid ester group having 2 to 5 total carbon atoms, an alkyl group having 1 to 5 carbon atoms or an alkoxyalkyl group having 2 to 5 total carbon atoms.

2. The color photographic light-sensitive material of claim 1, wherein said compound represented by the general formula (I) is

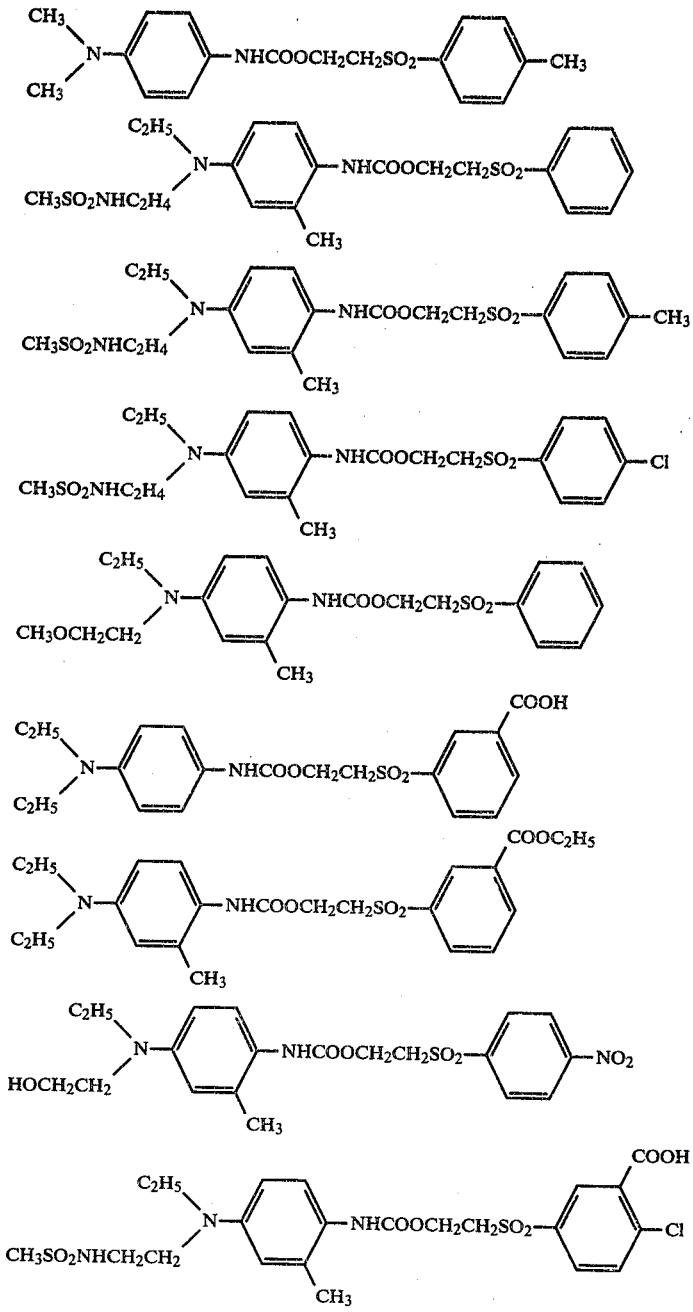

3. The color photographic light-sensitive material of claim 1, wherein said compound represented by the general formula (I) is present in said color photographic light-sensitive material in an amount of about 0.1 to about 10 molar times the total amount of silver per unit area of the color photographic light-sensitive material.

4. The color photographic light-sensitive material of claim 1, wherein said compound represented by the general formula (I) is present in a layer of said color photographic light-sensitive material other than said silver halide layer.

5. The color photographic light-sensitive material wherein said non-diffusible color coupler is a yellow dye forming coupler, a magenta dye forming color coupler or a cyan dye forming coupler.

6. A method of forming a color photographic image comprising developing an imagewise exposed color photographic light-sensitive material as claimed in claim 1, with a processing solution comprising an aqueous alkaline processing solution having a pH of about 8 to about 13.

* * * * *